United States Patent [19]

Gabrius

[11] Patent Number: 4,972,339

[45] Date of Patent: Nov. 20, 1990

[54] RECESSED LIGHT FIXTURE ASSEMBLY

[75] Inventor: Algimantas J. Gabrius, Carol Stream, Ill.

[73] Assignee: Juno Lighting, Inc., Des Plaines, Ill.

[21] Appl. No.: 493,950

[22] Filed: Mar. 15, 1990

[51] Int. Cl.[5] ..... F21S 1/06

[52] U.S. Cl. ..... 362/366; 362/365; 248/343

[58] Field of Search ..... 248/342, 343; 52/28; 362/365, 366, 150

[56] References Cited

U.S. PATENT DOCUMENTS

| | | | |
|---|---|---|---|
| 3,313,931 | 4/1967 | Klugman . | |
| 4,388,677 | 6/1983 | Druffel | 362/365 |
| 4,408,262 | 10/1983 | Kusmer | 362/365 |
| 4,723,747 | 2/1988 | Karp et al. | 362/365 |
| 4,729,080 | 3/1988 | Fremont et al. . | |
| 4,829,410 | 5/1989 | Patel | 362/365 |

OTHER PUBLICATIONS

*Juno Recessed Lighting* Catalog 1989, pp. 15 and 48–59.

*Primary Examiner*—Carroll B. Dority

*Attorney, Agent, or Firm*—Anthony S. Zummer

[57] ABSTRACT

A recessed light fixture assembly includes a plaster frame having a rectangular floor. A bar hanger bracket is supportably connected to each of two opposed edges of the floor. Each bar hanger bracket includes a support ledge supportably connected to its respective edge of the floor, and an upright sidewall formed integral with each support ledge. A bar hanger retaining finger is formed integral with each side of the sidewall. A pair of opposed retaining tabs is formed integral with each side of each sidewall and is spaced from the retaining finger on the respective side. A bar hanger including an elongated arm is positioned between each pair of retaining tabs and is thereby slideably connected to each bar hanger bracket and captured by the retaining finger. Each bar hanger has an elongated arm which arm has two assembly notches in one edge. The assembly notches of each elongated arm may be selectively aligned with respective retaining fingers to allow each bar hanger to be selectively connected or disconnected from its respective sidewall when the notches are aligned with their respective retaining fingers.

19 Claims, 4 Drawing Sheets

FIG. 6
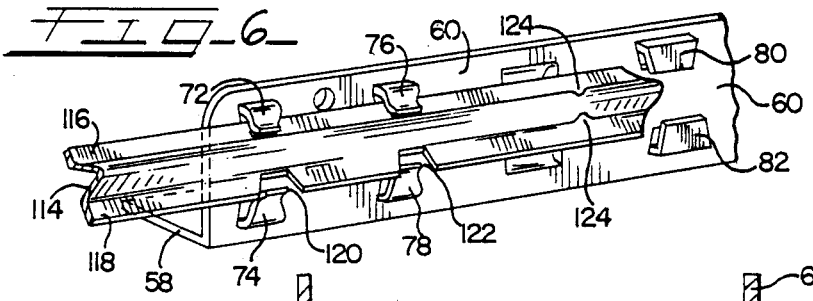
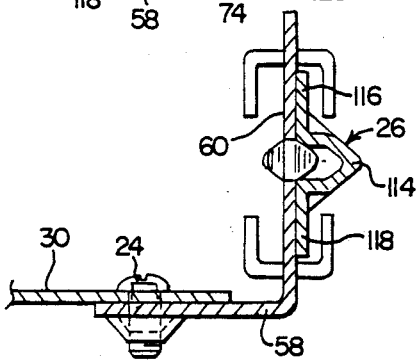
FIG. 7
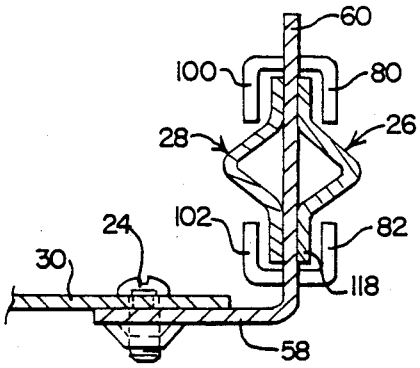
FIG. 8
FIG. 9
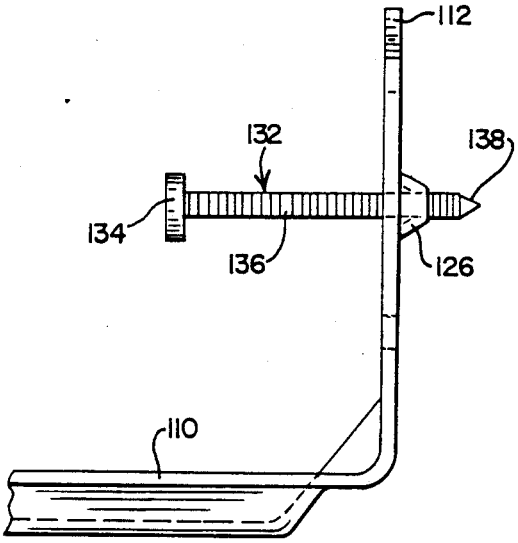
FIG. 10
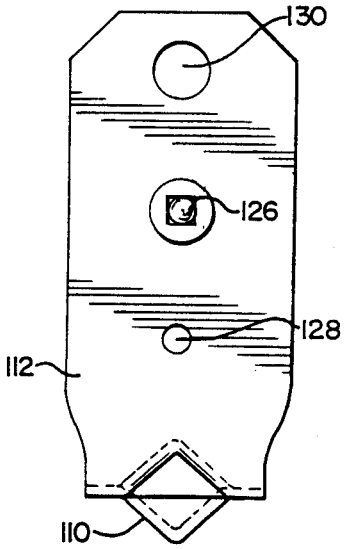

RECESSED LIGHT FIXTURE ASSEMBLY

BACKGRUOND OF THE INVNETION

The present invention relates to an improved recessed light fixture assembly. The utilization of recessed lighting especially in ceilings generally includes a plaster frame which has a substantially rectangular floor. A housing is mounted on the floor and a lamp socket is mounted within the housing. A wiring junction box is ordinarily mounted on the floor with a conduit from the junction box to the socket. The recessed light fixture is generally installed between either a pair of rafters or a pair of floor joist of an upper story. Once the light fixture is installed, generally either plaster board or plaster covers the plaster frame except for an opening through the floor which allows a lamp mounted in the lamp socket to provide light in a downward direction from the housing through the opening.

The utilization of a factory made light fixture assembly is well accepted in the lighting industry. One of the problems encountered in mounting the light fixture assembly between a pair of supporting structures is that the distance between rafters, floor joist or other supporting mechanism may vary. Accordingly, the typical construction of a light fixture assembly includes a pair of bar hanger brackets connected to opposite edges of the plaster frame. Each bar hanger bracket has a pair of bar hangers slidably connected thereto so that the overall length created by the bar hangers may be adjusted to accommodate the spacing between supporting members. Typically, the ends of the bar hangers have a supporting ear through which a fastener may pass to secure each bar hanger to a support member.

In the typical construction of a bar hanger bracket and bar hanger, the bar hanger is slideably captured to the bar hanger bracket, that is, the bar hanger may not be removed from the bar hanger bracket. In certain instances, it is desirable to remove one or both bar hangers from each bar hanger bracket. Since this is accomplished before installation, often times the workmen who effect the removal damage either the bar hanger bracket or the bar hanger or both. This results in a requirement for replacement of parts or some difficulty in installation. It is therefore necessary to provide a convenient means for capturing the bar hanger to the bar hanger bracket, but allowing the bar hanger to be removed in the field without damage to either the bar hanger or the bar hanger bracket.

In addition, it is noted that in certain instances, the positioning of the opening for the light must be close to one of the supporting members or the other so that it is desirable to be able to position selectively the bar hanger brackets relative to the plaster frame.

It is desirable to provide a lock for the bar hangers relative to the respective bar hanger brackets so that the plaster frame with the light opening is secured in a set position and is not moved when additional work is done around the light fixture assembly. Further, it is desirable to provide a convenient means for securing the mounting ear to the supporting structure.

SUMMARY OF TE INVENTION

The present invention relates to an improved recessed light fixture assembly. The instant recessed light fixture assembly includes a plaster frame which has a substantially rectangular floor. The frame has a light opening in the floor and a housing mounted over the light opening. The housing has a lamp socket mounted therein which socket is adapted to receive a lamp to provide lighting through the light opening. A wiring junction box is mounted on the floor. A conduit connects the wiring junction box with the lamp socket in the housing. A pair of bar hanger brackets is supportably connected to opposed edges of the floor. The bar hanger brackets are adjustably mounted relative to the floor for adjusting the position of the light opening.

Each bar hanger bracket includes a support ledge and a sidewall perpendicular to the support ledge. The support ledge is releasably connected to the floor of the plaster frame. Each sidewall has a retaining finger extending outward from each of the opposed sides of the sidewall. Each retaining finger is positioned adjacent to an opposed end of the sidewall. A pair of opposed retaining tabs is formed integral with each side of each sidewall. Each opposed retaining tab is spaced away from the retaining finger on the respective side of the sidewall. A bar hanger is slideably mounted in each pair of opposed retaining tabs. A lock is fixed to each side of each sidewall. Each bar hanger has an elongated arm which is positioned between the respective pair of retaining tabs. Each elongated arm has a stop engageable with the lock to limit movement of the bar hanger in one direction. Each elongated arm has an assembly notch in one edge and is alignable with the respective retainer finger to allow the bar hanger to be selectively connected or disconnected from the respective sidewall when the assembly notch is aligned with the respective retaining finger. Each elongated arm has a mounting ear on one end to provide a means for securing a fastener through the mounting ear and to a support member for supporting the bar hanger.

BRIEF DESCPRTION OFTHE DRAWING

FIG. 6 is similar to FIG. 5 but with the bar hanger partially rotated for connection or disconnection from the respective bar hanger bracket;

FIG. 7 is an enlarged cross sectional view showing a connection with a lock of the bar hanger bracket;

FIG. 8 is an enlarged cross sectional view taken on Line 8—8 of FIG. 4 showing the relative positioning of a pair of bar hangers relative to a bar hanger bracket;

FIG. 9 is an enlarged fragmentary view of one end of a bar hanger showing a mounting ear formed integral with an elongated arm of the bar hanger and a nail mounted in an integral nail retainer; and FIG. 10 is an end view of the mounting ear and elongated arm shown in FIG. 9.

DESCIRPTION OF THE PREFERRED EMBODIMETN

Figure 1:
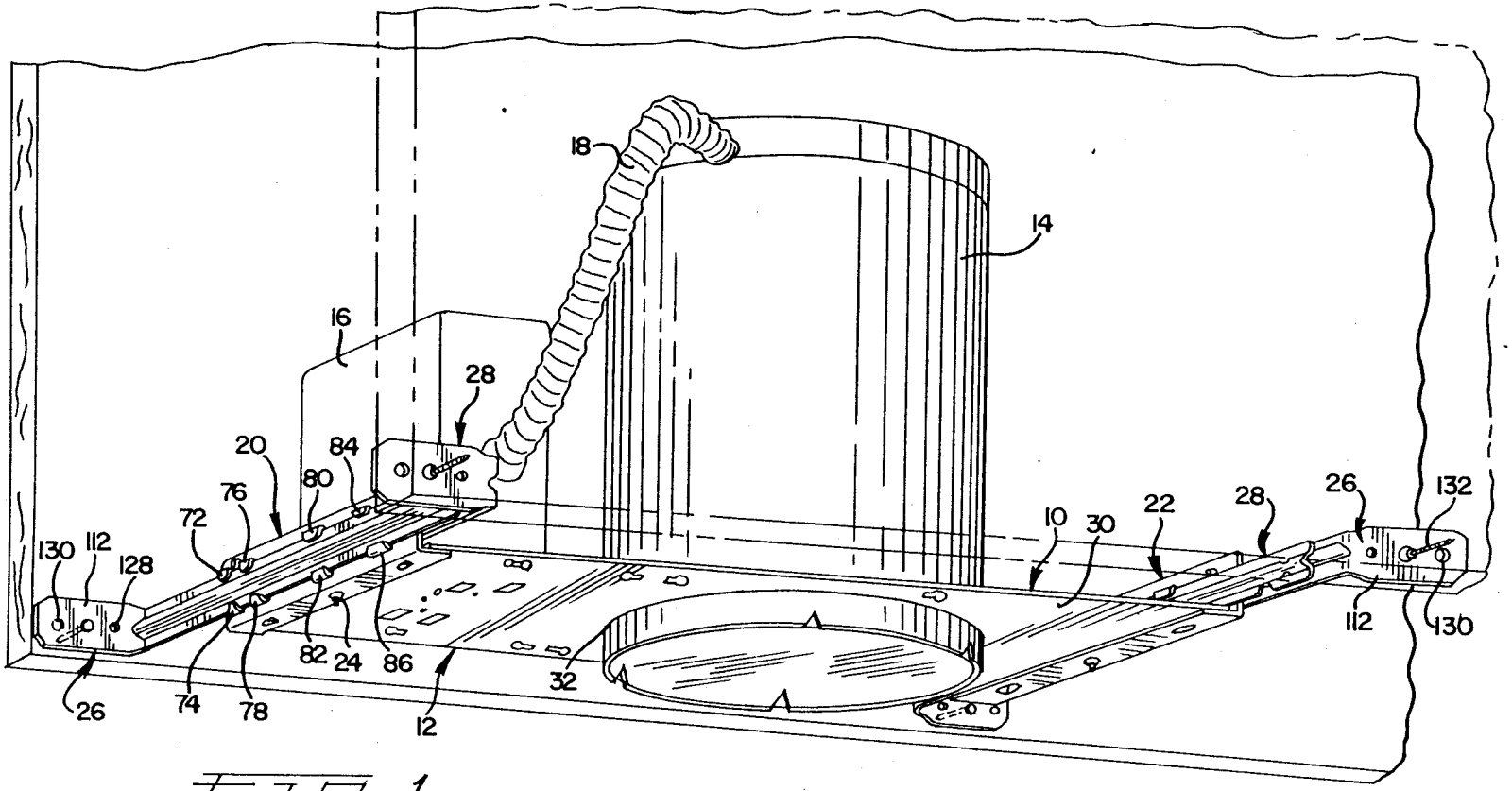
FIG. 1 is a perspective view of a recessed light fixture assembly embodying the herein disclosed invention shown mounted between a pair of conventional support members with one of the support members being shown in phantom view.

Referring now to the drawings and especially to FIG. 1, a recessed light fixture assembly being a specific embodiment of the herein disclosed invention is shown therein and is generally indicated by numeral 10. Recessed light fixture assembly 10 generally includes a plaster frame 12 with a conventional housing 14 mounting on plaster frame 12. A conventional lamp socket is mounted within the housing 14 and is not shown therein inasmuch as any suitable lamp socket may be used with the instant light fixture assembly. A conventional wiring junction box 16 is mounted on the plaster frame and is electrically connected to the aforementioned lamp socket in housing 14 through a conventional conduit 18. Identical bar hanger brackets 20 and 22 are connected to opposite edges of the plaster frame 12 and are secured to the plaster frame by identical fasteners 24. A left bar hanger 26 is mounted in sliding engagement with one side of bar hanger bracket 20 and a right bar hanger 28 is mounted on the other side of bar hanger bracket 20. A like left bar hanger 26 is mounted on one side of bar hanger bracket 22 and a like right bar hanger 28 is mounted on the other side of bar hanger bracket 22.

Figure 2:
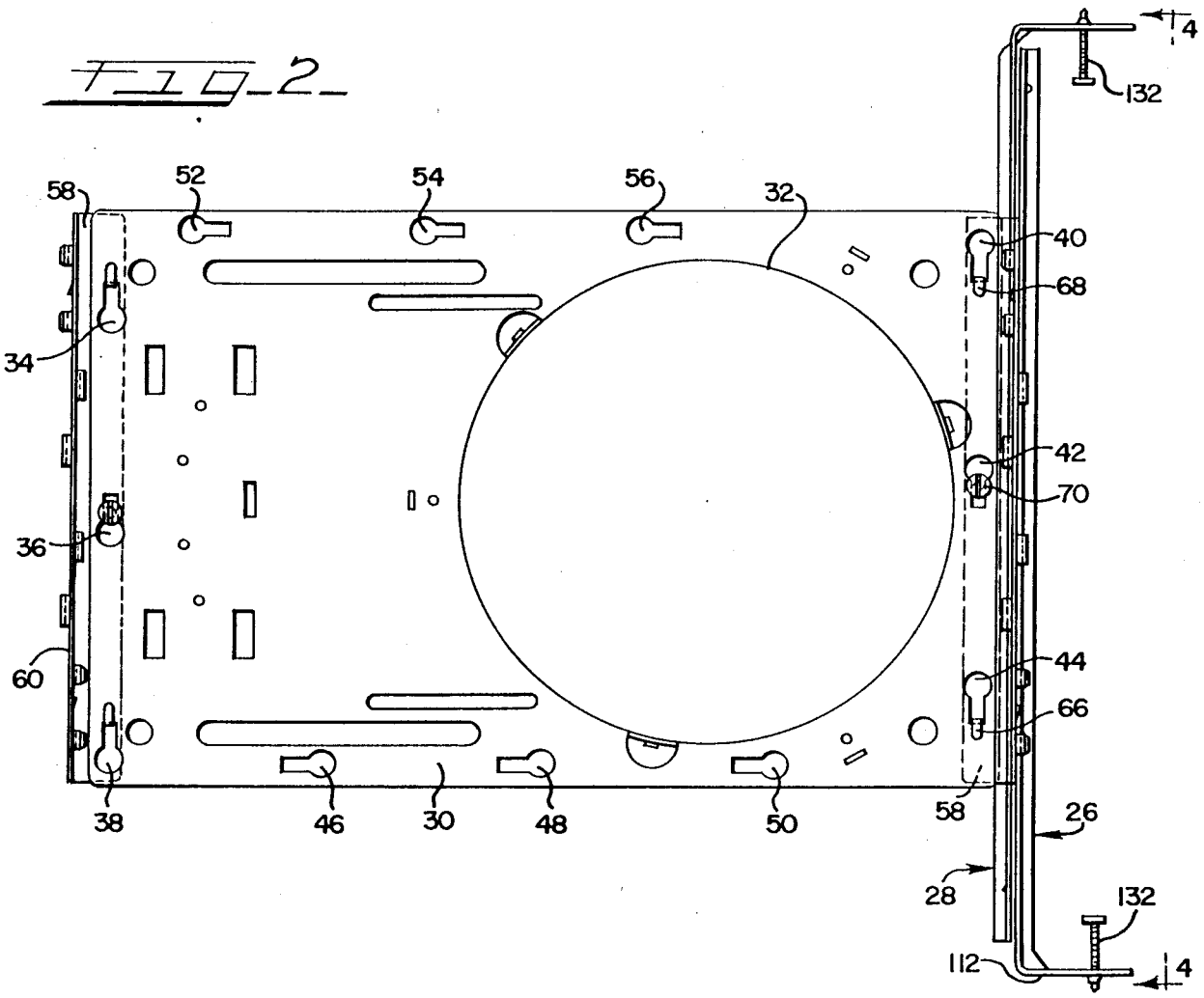
FIG. 2 is a top plan view of the recessed light fixture assembly shown in FIG. 1 but with a junction box and conduit removed in order to show the construction of the assembly and with a pair of bar hangers removed on one side in order to show better the construction of a hanger bracket secured to one edge of a plaster frame.

Plaster frame 12 includes a floor 30 which is rectangular as may be best seen in FIG. 2. The floor includes a light aperture 32 with housing 14 extending through the floor at light aperture 32. Three keyhole shaped hook mounting apertures 34, 36 and 38 are formed in floor 30 adjacent to one edge. Keyhole aperture 36 is equidistantly spaced from keyhole apertures 34 and 38 and the three apertures are in line with the keyhole shape being aligned in the same direction for all three apertures.

Three identical keyhole shaped hook mounting apertures 40, 42 and 44 are formed in floor 30 adjacent to the opposite edge. Keyhole aperture 42 is equidistantly spaced from keyhole apertures 40 and 44 and the space between apertures 42 and 40 and 42 and 44 is the same as the space between keyhole apertures 36 and 34 and 36 and 38, respectively. The keyhole apertures 40, 42, and 44 are identical in shape and size and are identical to the keyhole apertures 34, 36 and 38. Keyhole apertures 40, 42 and 44 are arranged in line and extend in the same direction.

Three keyhole hook apertures 46, 48 and 50, identical in shape and size to keyhole apertures 34, 36 and 38, are formed in floor 30 adjacent to an edge of floor 30 which is perpendicular to the edge along which keyhole apertures 34, 36 and 38 are positioned. Keyhole aperture 48 is equidistantly spaced from keyhole apertures 46 and 50, and the three apertures are arranged in line with the apertures extending in the same direction. The spacing between the apertures 46, 48 and 50 is the same as the spacing between apertures 34, 36 and 38, respectively.

Hook apertures 52, 54 and 56 which are identical to apertures 34, 36 and 38, are formed in floor 30 adjacent to an edge which is parallel to but opposite to the edge along which keyhole apertures 46, 48 and 50 are arranged. Keyhole aperture 54 is equidistantly spaced from keyhole apertures 52 and 56. The spacing between keyhole apertures 52, 54 and 56 is identical to the spacing between keyhole apertures 34, 36 and 38, respectively.

Bar hanger bracket 22 which is identical to bar hanger bracket 20 (like numbers are used for both bar hanger brackets) includes a ledge 58 with a sidewall 60 formed integral therewith and substantially perpendicular to ledge 58. Ledge 58 includes a fastener boss 62 with a fastener aperture 64 contained therein. A pair of locating hooks 66 and 68 is formed integral with the ledge. Each of the locating hooks 66 and 68 is formed as part of ledge 58. Fastener aperture 64 is equidistantly spaced from locating hooks 66 and 68. The distance from fastener aperture to each of the locating hooks 66 and 68 is identical to the distance from keyhole aperture 36 to keyhole apertures 34 and 38. This allows the locating hooks 66 and 68 to be positioned in keyhole apertures 44 and 40, respectively, to lock the hanger bracket to floor 30. Fastener 24 is mounted in fastener aperture 64 to secure hanger bracket 22 to floor 30.

Figures 3, 4, 5:
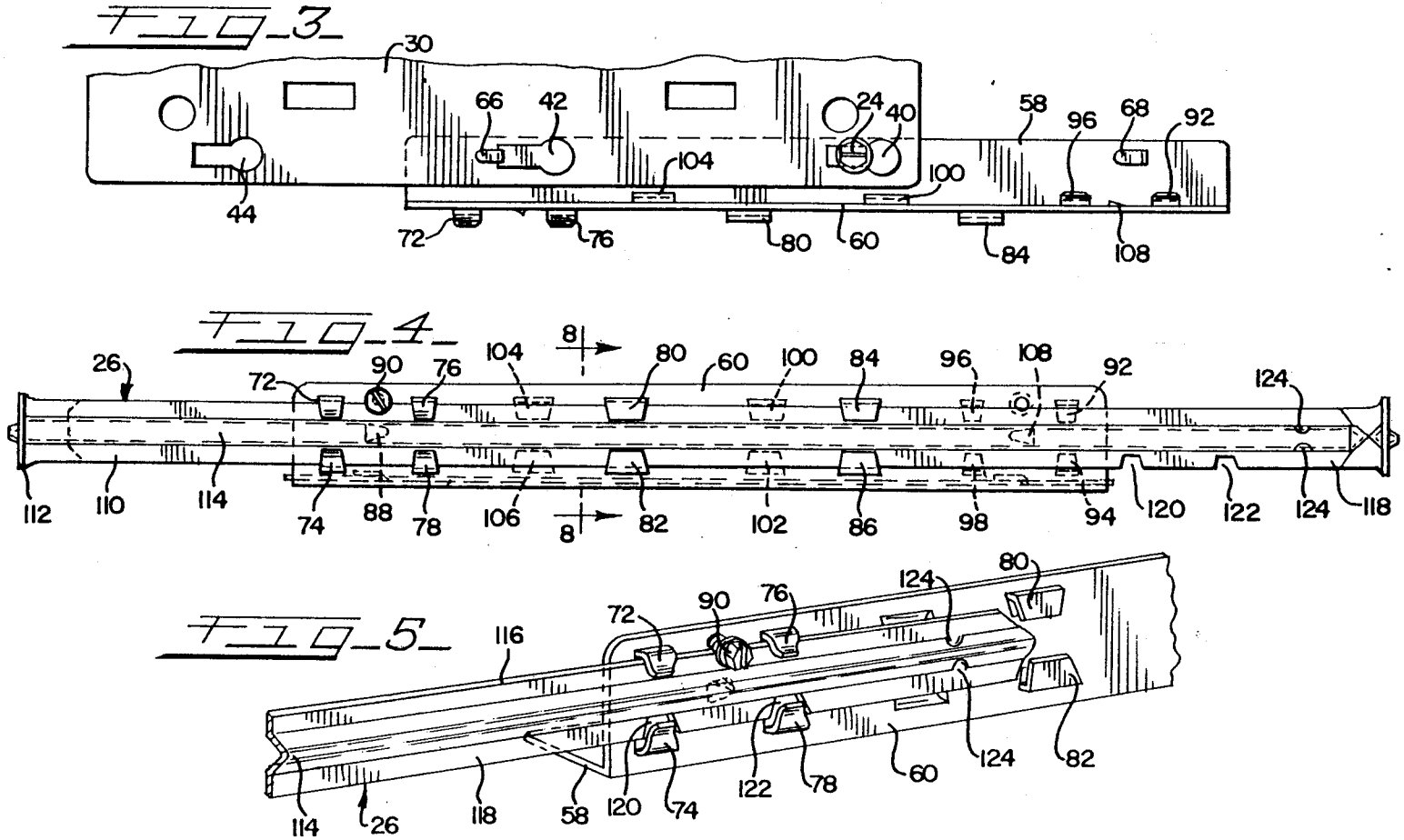
FIG. 3 is an enlarged fragmentary top plan view showing the supporting connection of a bar hanger bracket with a portion of the plaster frame.
FIG. 4 is an enlarged side elevational view taken on Line 4—4 of FIG. 2 showing the interrelationship of a pair of bar hangers with a bar hanger bracket.
FIG. 5 is an enlarged perspective view showing a portion of an elongated arm of a bar hanger with assembly notches of the bar hanger aligned with retaining fingers of the bar hanger bracket for connection and disconnection of the bar hanger with the bar hanger bracket.

It may be appreciated that in the event it is necessary to offset the plaster frame relative to bar hanger brackets 20 and 22, the arrangement shown in FIG. 3 may be utilized. Hook 66 is positioned in keyhole aperture 42. Fastener 24 is positioned in keyhole aperture 40 where fastener 24 is secured to the floor 30.

Sidewall 60 has a pair of opposed retaining fingers 72 and 74 on the outer side of the sidewall. A second pair of opposed retaining fingers 76 and 78 is formed integral with the same outer side of the retaining fingers 72 and 74 but inward from the end of the sidewall, as may be best seen in FIGS. 4 or 5, to form a set of two pairs of opposed retaining fingers. Each of the retaining fingers has an outwardly extending lip. A pair of spaced retaining tabs 80 and 82 is formed integral with the outer surface of sidewall 60. Retaining tabs 80 and 82 are positioned in line with the retaining fingers 72 and 74 and 76 and 78. A second pair of retaining tabs 84 and 86 is also formed integral with the outer side of sidewall 60 and being spaced away from retaining tabs 80 and 82. Retaining tabs 84 and 86 are also arranged in line with retaining fingers 72, 74, 76 and 78, and retaining tabs 80 and 82 to form a set of two pairs of retaining tabs. A locking tab 88 is formed integral with the outer side of sidewall 60 between the pair of locking tabs 72 and 74, and the pair of locking tabs 76 and 78. A locking fastener 90 is mounted in sidewall 60 between retaining fingers 78 and 76.

The other side or inner side of sidewall 60 has like retaining fingers, retaining tabs and locking tab. A pair of retaining fingers 92 and 94 is formed integral with the end of the sidewall opposite the end adjacent to retaining fingers 72 and 74. A second pair of opposed retaining fingers 96 and 98 is formed on the inner side of sidewall 60. A pair of opposed retaining tabs ioo and 102 is formed integral with the inner side of the sidewall. A seoond pair of opposed retaining tabs 104 and 106 is formed inteqral with the inner side of sidewall 60. As with their counterparts on the opposite side of the sidewall, retaining fingers 92 and 96 and retaining tabs 100 and 104 are in line as are retaining fingers 94 and 98, and retaining tabs 102 and 106. The retaining tabs 100, 102, 104 and 106 are identical in their construction and have a width greater than the retaining fingers 92, 94, 96 and 98. A locking tab 108 is formed integral with the inner side of sidewall 60.

Left bar hanger 26 is in restricted sliding engagement with the outer side of sidewall 60 of bar hanger bracket 22. Bar hanger 26 includes an elongated arm 110 and a mounting ear 112 formed integral with one end of the elongated arm. Elongated arm 10 includes a deep crease stiffening rib 114 which extends along the entire length of the arm. The elongated arm includes an upper edge 116 and a lower edge 118. The lower edge of the arm includes a pair of assembly notches 120 and 122. The notches are identical in size. Notches 120 and 122 are similar in shape to retaining fingers 74 and 78, respectively, but are slightly larger so that the retaining fingers may pass through the respective notches. The stiffening rib has a pair of indentations 124 formed therein which form a locking stop when they engage locking tab 88. Right bar hanger 28 is mounted on the inner side of sidewall 60 in the same manner that bar hanger 26 is mounted on the outer side described above.

Mounting ear 112 includes an integral nail retainer 126 and a nail aperture 128 positioned between the nail retainer and the end of the elongated arm. An enlarged aperture 130 is formed in the mounting ear adjacent to the nail retainer and is spaced away from the nail aperture. A ring shank drywall nail 132 is mounted in the nail retainer 126. The nail includes a conventional head 134 with a shaft 136 formed integral with the head and a point 138 protruding through the mounting ear.

Bar hanger bracket 20 is connected to floor 30 of the plaster frame in the same manner that bar hanger bracket 22 is connected to the plaster frame and the bar hangers 26 and 28 are mounted in bar hanger bracket 20 in the same manner as the bar hangers are mounted in bar hanger bracket 22.

The instant recessed light fixture assembly is customarily shipped by the manufacturer with all parts assembled. Inasmuch as the bar hangers are captured in place, they will remain in place and will not become lost. When the instant recessed lighting fixture assembly is to be installed, the bar hangers are adjusted to the selected distance between conventional floor joists, rafters or other supporting structure. In the event that it is necessary to arrange the plaster frame at 90° to that shown in FIG. 1, the bar hanger brackets may be mounted in keyhole apertures 46, 48 and 50 and keyhole apertures 52, 54 and 56. Once the position of the plaster frame is established, the bar hangers are secured to the supporting members, such as, the rafters or floor joists by driving nails 132 into the supporting members. In the event that the nails should become bent, another nail may be used in its stead and inserted through the nail aperture 128. In some instances, screws or roofing nails having a substantially bigger shank may be used for securing the bar hangers and in those instances, enlarged aperture 130 will receive those fasteners having larger shanks.

In the event that it is necessary to remove a bar hanger from the bar hanger bracket, the bar hanger may be readily removed by sliding the bar hanger to the position shown in FIG. 5 wherein assembly notches 120 and 122 are aligned with retaining fingers 74 and 78. The bar hanger is then rotated as shown in FIG. 6 so that the retaining fingers pass through the notches. The bar hanger is thus disengaged from the bar hanger bracket. Inasmuch as the assembly notches 120 and 122 are narrower than the retaining tabs, the only place that the bar hanger can be removed is at one given location relative to the retaining fingers. The position of the assembly notches on lower edge 118 allows the bar hangers to support the housing via the bar hanger bracket and allows smooth sliding of the upper edge 116 with retaining fingers 72 and 76 and tabs 80 and 82. The upper edge 116 of the elongated arm has a smooth continuous surface so that the bar hanger bracket may glide on the upper edge, however, when it is required to disengage the bar hanger bracket from the bar hanger, this may be accomplished readily as described above. When it is necessary to reinsert the bar hanger into the bar hanger bracket, the bar hanger is positioned with its upper edge 116 under the retaining fingers 72 and 76, and aligning with retaining fingers 74 and 78, respectively, then rotating the hanger bracket to hold the hanger bracket in sliding engagement with the hanger bracket.

Once the position of the plaster frame and thus the light aperture 32 is determined for a given location, the positioning of each bar hanger relative to its respective bar hanger bracket is secured by the locking bar lock fasteners 90 to secure the bar hangers to the respective bar hanger bracket which prevents sliding movement of the bar hangers relative to the respective bar hanger bracket.

In its preferred embodiment, the plaster frame, hanger bracket, and bar hangers are made of steel, however, it may be readily appreciated that they may be made of any other conventional construction material, such as, aluminum, plastic or other suitable material.

Although a specific embodiment of the herein disclosed invention has been shown in the accompanying drawings and described in detail above, it is readily apparent that those skilled in the art may make various modifications and changes without departing from the spirit and scope of the present invention. It is to be expressly understood that the instant invention is limited only by the appended claims.

What is claimed is:

1. A recessed light fixture assembly including; a plaster frame, a bar hanger bracket supportably connected to the plaster frame, said bar hanger bracket including a retaining finger formed integral therewith, a pair of opposed retaining tabs formed integral with the bar hanger bracket and being spaced away from the retaining finger, and a bar hanger slideably connected to the bar hanger bracket, said bar hanger including an elongated arm positioned between the pair of retaining tabs to be held therebetween, said elongated arm having an assembly notch in one edge and being alignable with the retaining finger to allow the bar hanger to be selectively connected to or disconnected from the bar hanger bracket when the notch is aligned with the retaining finger.

2. A recessed light fixture assembly as defined in claim 1, including a lock fixed to the bar hanger bracket, and said elongated arm of the bar hanger having a stop engageable with the lock to limit movement of the bar hanger relative to the bar hanger bracket in one direction.

3. A recessed light fixture assembly as defined in claim 1, wherein the bar hanger includes a mounting ear formed integral with one end of the elongated arm, said mounting ear having a nail retainer formed therein.

4. A recessed light fixture assembly as defined in claim 1, wherein said plaster frame has a floor, said floor having at least two hook apertures arranged in line along one edge of the floor, said bar hanger bracket having a locating hook formed therein, said bar hanger bracket having a fastener aperture spaced from the locating hook substantially the same distance that the keyhole apertures are spaced apart on the floor of the plaster frame, said hook being positioned in one keyhole aperture, and a fastener mounted in the fastener aperture and being positioned in the other keyhole aperture to lock the bar hanger bracket to the plaster frame.

5. A recessed light fixture assembly as defined in claim 1, wherein the bar hanger includes a mounting ear formed integral with one end of the elongated arm, said mounting ear having a nail retainer, and a nail mounted in the nail retainer.

6. A recessed light fixture assembly as defined in claim 1, wherein the bar hanger includes a mounting ear formed integral with one end of the elongated arm, a nail retainer formed integral with the mounting ear, a nail mounted in the nail retainer, a nail aperture in said mounting ear having a diameter greater than the diameter of the nail, and said mounting ear having an enlarged aperture having a diameter substantially greater than the diameter of the nail.

7. A recessed light fixture assembly as defined in claim 1, including; a lock fixed to the bar hanger bracket, said elongated arm of the bar hanger having a stop engageable with the lock to limit movement of the bar hanger relative to the bar hanger bracket in one direction, said bar hanger including a mounting ear formed integral with one end of the elongated arm, and said mounting ear having a nail retainer formed therein.

8. A recessed light fixture assembly as defined in claim 1, wherein said plaster frame includes a floor, said floor having at least two hook apertures in line along an edge of the floor, said bar hanger bracket having a locating hook formed therein, said bar hanger bracket having a fastener aperture spaced from the locating hook the same distance that the hook apertures are spaced apart on the floor of the plaster frame, said hook being positioned in one hook aperture, a fastener mounted in the fastener aperture and being positioned in the other hook aperture to lock the bar hanger bracket to the plaster frame, a lock fixed to the bar hanger bracket, and said elongated arm of the bar hanger having a stop engageable with the lock to limit movement of the bar hanger relative to the bar hanger bracket in one direction.

9. A recessed light fixture assembly as defined in claim 1, including; a lock fixed to the bar hanger bracket, said elongated arm of the bar hanger having a stop engageable with the lock to limit movement of the bar hanger relative to the bar hanger bracket in one direction, a mounting ear formed integral with one end of the elongated arm, a nail retainer formed integral with the mounting ear, a nail mounted in the nail retainer, an aperture in said mounting ear having a diameter greater than the diameter of the nail, and said mounting ear having a second aperture having a diameter substantially greater than the diameter of the nail.

10. A recessed light fixture assembly as defined in claim 1, wherein said plaster frame includes a floor, said floor having at least two hook apertures in line along the edge of the floor, said bar hanger bracket having a locating hook formed therein, said bar hanger bracket having a fastener aperture spaced from the locating hook substantially the same distance that the hook apertures are spaced apart on the floor of the plaster frame, said hook being positioned in one hook aperture, a fastener mounted in the fastener aperture and being positioned in the other hook aperture to lock the bar hanger bracket to the plaster frame, said bar hanger including a mounting ear formed integral with one end of the elongated arm, and said mounting ear having a nail retainer formed therein.

11. A recessed light fixture assembly as defined in claim 1, wherein said plaster frame includes a substantially rectangular floor, said floor having at least two hook apertures in line along an edge of the floor, said bar hanger bracket having a locating hook formed therein, said bar hanger bracket having a fastener aperture spaced from the locating hook substantially the same distance that the hook apertures are spaced apart on the floor of the plaster frame, said locating hook being positioned in one hook aperture, a fastener mounted in the fastener aperture and being positioned in the other hook aperture to lock the bar hanger bracket to the plaster frame, said bar hanger including a mounting ear formed integral with one end of the elongated arm, a nail retainer formed integral with the mounting ear, a nail mounted in the nail retainer, a nail aperture in said mounting ear having a diameter greater than the diameter of the nail, and said mounting ear having an enlarged aperture having a diameter substantially greater than the diameter of the nail.

12. A recessed light fixture assembly as defined in claim 1, wherein said plaster frame includes a floor, said floor having at least two hook apertures in line along an edge of the floor, said bar hanger bracket having a locating hook formed therein, said bar hanger bracket having a fastener aperture spaced from the locating hook substantially the same distance that the hook apertures are spaced apart on the floor of the plaster frame, said hook being positioned in one hook aperture, a fastener mounted in the fastener aperture and being positioned in the other hook aperture to lock the bar hanger bracket to the plaster frame, a lock fixed to the bar hanger bracket, said elongated arm of the bar hanger having a stop adjacent to one end engageable with the lock to limit movement of the bar hanger relative to the bar hanger bracket in one direction, a mounting ear formed integral with the other end of the elongated arm, and said mounting ear having a nail retainer formed therein.

13. A recessed light fixture assembly as defined in claim 1, wherein said plaster frame includes; a floor, said floor having three hook apertures substantially equidistantly spaced in line along an edge of the floor, said bar hanger bracket having a hook formed therein, said bar hanger bracket having a fastener aperture spaced from the hook the same distance that adjacent hook apertures are spaced apart on the floor of the plaster frame, said hook being positioned in one hook aperture, a fastener mounted in the fastener aperture and being positioned in another hook aperture to lock the bar hanger bracket to the plaster frame, a lock fixed to the bar hanger bracket, said elongated arm of the bar hanger bracket having a stop adjacent to one end of the arm engageable with the lock to limit movement of the bar hanger relative to the bar hanger bracket in one direction, said bar hanger including a mounting ear formed integral with the other end of the elongated arm, a nail retainer formed integral with the mounting ear, a nail mounted in the nail retainer, a nail aperture in said mounting ear having a diameter slightly greater than the diameter of the nail, and said mounting ear having an enlarged aperture having a diameter substantially greater than the diameter of the nail.

14. A recessed light fixture assembly as defined in claim 1, wherein said plaster frame has a rectangular floor, said floor having a group of keyhole shaped mounting apertures positioned adjacent to a pair of opposed edges thereof, each group of keyhole shaped mounting apertures having at least three apertures in the group with the keyhole shaped mounting apertures arranged in line and aligned in the same direction, a second bar hanger bracket identical to the first mentioned bar hanger bracket, said bar hanger brackets being connected to the opposed edges of the floor, each of said bar hanger brackets including a ledge supportably positioned below the rectangular floor adjacent to its respective edge, an elongated sidewall formed integral with and substantially perpendicular to each ledge, each ledge including a pair of locating hooks formed integral therewith and facing in the same direction, each ledge including a fastener aperture positioned midway between the respective locating hooks and in line with the locating hooks, the distance between the fastener aperture and each respective locating hook being equal to the distance between adjacent keyhole shaped mounting apertures of each group, each hook positioned in its respective keyhole shaped mounting aperture in engagement with the floor, a second bar hanger slideably connected to the second bar hanger bracket, said second bar hanger bracket including a second retaining finger, a second pair of opposed retaining tabs formed integral with the second bar hanger bracket and being spaced away from the second retaining finger, a second bar hanger slideably connected to the second bar hanger bracket, said second bar hanger including a second elongated arm positioned between the second pair of retaining tabs to be held therebetween, and said second elongated arm having a second assembly notch in one edge and being alignable with the second retaining finger to allow the second bar hanger to be selectively connected to or disconnected from the second bar hanger bracket when the second notch is aligned with the second retaining finger.

15. A recessed light fixture assembly as defined in claim 1, including, a second bar hanger bracket supportably connected to the rectangular floor, the bar hanger brackets being connected to opposed edges of the floor, each of said bar hanger brackets including a ledge supportably positioned below the rectangular floor adjacent to its respective edge, an elongated sidewall formed integral with and substantially perpendicular to each ledge, the first mentioned retaining finger and an opposed retaining finger being formed integral with one side of the sidewall of the first mentioned bar hanger bracket with a second pair of like opposed retaining fingers to form a first set of two pairs of opposed retaining fingers with each pair being longitudinally spaced from each other adjacent to one end thereof and a second set of two pairs of opposed retaining fingers with each pair being longitudinally spaced from each other formed integral with the opposite side of the sidewall adjacent to the opposite end thereof, each of said retaining fingers having the same width as each other retaining finger, each sidewall having a first set of two pairs of opposed retaining tabs with each pair of tabs being longitudinally spaced from each other formed integral with one side of the sidewall spaced from the retaining fingers on the same side and a second set of two pairs of opposed retaining tabs with each pair of tabs being longitudinally spaced from each other formed integral with the opposite side of the sidewall spaced from the retaining fingers on the same side, each of said retaining tabs having a width equal to the width of each other retaining tab, each of said retaining tabs having a width greater than the width of each of the retaining fingers; the first mentioned bar hanger and a second bar hanger slideably mounted on the sidewall of the first mentioned bar hanger bracket, a second pair of bar hangers slideably mounted on the sidewall of the second bar hanger bracket, the second bar hanger and the each of the bar hangers of the second pair having an elongated arm identical to the elongated arm of the first mentioned bar hanger, each bar hanger having an elongated arm positioned between pairs of opposed retaining fingers and retaining tabs on one side of the respective sidewall, the first mentioned arm having a second assembly notch and each other arm having a pair of assembly notches along its lower edge being spaced from each other the same distance between adjacent pairs of retaining fingers, each of said notches having a slightly greater width than the retaining fingers but less than the retaining tabs to allow each bar hanger to swing past the respective retaining fingers when the notches are aligned with the respective retaining fingers.

16. A recessed light fixture assembly including; a plaster frame, said plaster frame including a substantially rectangular floor, said floor having at least two keyhole apertures in line along an edge of the floor, a bar hanger bracket supportably connected to the plaster frame, said bar hanger bracket having a locating hook formed therein and a fastener aperture spaced from the locating hook the same distance that the keyhole apertures are spaced apart on the floor of the plaster frame, said hook being positioned in one keyhole aperture, a fastener mounted in the fastener aperture and being positioned in the other keyhole aperture to lock the bar hanger bracket to the plaster frame, and a bar hanger slideably connected to the bar hanger bracket.

17. A recessed light fixture assembly as defined in claim 16, wherein the bar hanger includes a mounting ear formed integral with the one end of the elongated arm, and said mounting ear having a nail retainer formed therein.

18. A recessed light fixture assembly as defined in claim 16, wherein the bar hanger includes an elongated arm having a mounting ear formed integral with one end of the elongated arm, a nail retainer formed integral with the mounting ear, a nail mounted in the nail retainer, a nail aperture in said mounting ear having a diameter slightly greater than the diameter of the nail, and said mounting ear having a support aperture having a diameter substantially greater than the diameter of the nail.

19. A recessed light fixture assembly including; a plaster frame, said plaster frame having a rectangular floor, said floor having a group of keyhole shaped mounting apertures positioned adjacent to each edge thereof, each group of keyhole shaped mounting apertures having at least three keyhole shaped mounting apertures in the group with the keyhole shaped mounting apertures arranged in line and aligned in the same direction; a pair of bar hanger brackets supportably connected to the rectangular floor, the bar hanger brackets being connected to opposed edges of the floor, each of said bar hanger brackets including a ledge supportably positioned below the rectangular floor adjacent to its respective edge, an elongated sidewall formed integral with and substantially perpendicular to each ledge, each ledge including a pair of spaced locating hooks formed integral therewith and facing in the same direction, each ledge including a fastener aperture positioned midway between the respective locating hooks and in line with the locating hooks, the distance between the fastener aperture and each respective locating hook being equal to the distance between adjacent keyhole shaped mounting apertures of each group, each hook positioned in its respective keyhole shaped mounting aperture in engagement with the floor, each sidewall having a first set of two pairs of opposed retaining fingers with each pair being longitudinally spaced from each other formed integral with one side of the sidewall adjacent to one end thereof and a second set of two pairs of opposed retaining fingers with each pair being longitudinally spaced from each other formed integral with the opposite side of the sidewall adjacent to the opposite end thereof, each of said retaining fingers having the same width as each other retaining finger, each sidewall having a locking tab positioned between each set of two pairs of opposed retaining fingers, each sidewall having a first set of two pairs of opposed retaining tabs with each pair being longitudinally spaced from each other formed integral with one side of the sidewall spaced from the retaining fingers on the same side and a second set of two pairs of opposed retaining tabs with each pair being longitudinally spaced from each other formed integral with the opposite side of the sidewall spaced from the retaining fingers on the same side, each of said retaining tabs having a width equal to the width of each other retaining tab, each of said retaining tabs having a width greater than the width of the retaining fingers; a fastener lockably positioned in each fastener aperture and through its respective keyhole shaped mounting aperture to lock each bar hanger bracket to the floor; a pair of bar hangers slideably mounted on each of the sidewalls, each bar hanger having an elongated arm positioned between pairs of opposed retaining fingers and retaining tabs on one side of the respective sidewall, each arm of each bar hanger having a deep crease stiffening rib extending along its length with the rib positionable between opposed retaining fingers and opposed retaining tabs, each arm having a pair of assembly notches along its lower edge being spaced from each other the same distance between adjacent pairs of retaining fingers, each of said notches having a slightly greater width than the retaining fingers but less than the retaining tabs to allow the bar hanger to swing past the retaining fingers when the notches are aligned with the respective retaining fingers, a locking stop formed integral with each arm adjacent to the respective assembly notches engageable with its respective locking tab to restrict movement of the bar hanger in one direction, each bar hanger having a mounting ear formed integral with and substantially perpendicular to the respective arm at the end opposite to the end adjacent to the assemble notches, said mounting ear having a nail retainer, said mounting ear having a nail aperture and an enlarged aperture larger than the nail aperture; and a nail positioned in the nail retainer, and a bar lock fastener releasably locking each bar hanger to its respective sidewall.

* * * * *

UNITED STATES PATENT AND TRADEMARK OFFICE

CERTIFICATE OF CORRECTION

PATENT NO. : 4,972,339

DATED : November 20, 1990

INVENTOR(S) : Algimantas J. Gabrius

It is certified that error appears in the above-identified patent and that said Letters Patent is hereby corrected as shown below:

Column 1, Line 4 cancel, "INVNETION" and substitute--therefor--INVENTION

Column 1, Line 63, cancel "TE" and substitute--therefor--THE

Column 2, Line 36, cancel "DESCPRTION OFTHE DRAWING" and substitute--therefor--DESCRIPTION OF THE DRAWINGS Column 3, Line 9, cancel "DESCIRPTION OF THE PREFERRED EMBODIMETN" and substitute--therefor--DESCRIPTION OF THE PREFERRED EMBODIMENT Column 4, Line 57, cancel "i00" and substitute--therefor--100

Column 5, Line 5, cancel "10" and substitute--therefor--110

Signed and Sealed this

Thirty-first Day of March, 1992

*Attest:*

HARRY F. MANBECK, JR.

*Attesting Officer*

*Commissioner of Patents and Trademarks*